United States Patent [19]

Carroll

[11] Patent Number: 4,473,944

[45] Date of Patent: Oct. 2, 1984

[54] SQUEEGEE FOR RAZOR

[76] Inventor: Patrick M. Carroll, 3747 Dunnica, St. Louis, Mo. 63116

[21] Appl. No.: 331,165

[22] Filed: Dec. 16, 1981

[51] Int. Cl.[3] ..... B26B 19/38

[52] U.S. Cl. ..... 30/41; 30/90

[58] Field of Search ..... 30/41, 90, 41.5, 32, 30/34.2; 15/245, 121; 7/158, 170

[56] References Cited

U.S. PATENT DOCUMENTS

| | | | |
|---|---|---|---|
| 1,453,014 | 4/1923 | Kohn | 30/41 X |
| 1,677,954 | 7/1928 | Cleary | 30/90 X |
| 2,548,959 | 4/1951 | Eisenberg | 30/34.2 |
| 2,600,880 | 6/1952 | Karle | 30/90 |
| 2,980,457 | 4/1961 | Page | 15/245 X |
| 3,777,396 | 12/1973 | Simonetti | 30/47 |
| 3,895,437 | 7/1975 | Di Buono | 30/90 |
| 4,075,730 | 2/1978 | Siemund | 15/245 |

FOREIGN PATENT DOCUMENTS

| | | | |
|---|---|---|---|
| 427645 | 4/1935 | United Kingdom | 30/34.2 |

*Primary Examiner*—Jimmy C. Peters

*Attorney, Agent, or Firm*—Mason, Kolehmainen, Rathburn & Wyss

[57] ABSTRACT

A squeegee is secured to a razor to permit a person to wipe and remove water condensation due to steam or water vapor from a reflecting surface, such as a mirror. Preferably, the squeegee is formed from a soft or compliant elastomeric material, such as rubber or a suitable synthetic material, and extends generally along a longitudinal axis that is parallel to the plane of the razor blade. The squeegee is also useful in removing shaving cream or lather from the portion of the anatomy to be shaved. The squeegee may be integrally formed on the head or on the body or handle of the razor. Alternatively, the squeegee may be formed on a replaceable cartridge for a cartridge-type razor or as an attachment to the handle of a razor.

21 Claims, 11 Drawing Figures

SQUEEGEE FOR RAZOR

BACKGROUND OF THE INVENTION

A. Field of the Invention

The device of the present invention generally relates to razors used for personal grooming and, more particularly, to a new and improved razor that includes a squeegee affixed thereto for wiping and removing water condensation due to steam or water vapor from a reflecting surface, such as a mirror.

B. Description of the Prior Art

Razors having sharpened blades for personal grooming are old and well known in the art. Examples of such razors are straight razors and safety razors, including cartridge-type razors. Often the act of shaving takes place in the presence of very hot water, resulting in the presence of steam or water vapor. For example, very often the act of shaving occurs during or after the act of bathing or showering as a part of an individual's personal grooming routine. Furthermore, very frequently the act of shaving occurs in a confined area such as a bathroom, where ventilation may be less than adequate. In such instances, steam or water vapor may be present and may condense as water on a reflecting surface, such as a mirror, used by an individual during the act of shaving. The presence of such water condensation normally prevents an individual from being able to accurately, rapidly and safely perform the act of shaving. Thus, an individual may find it necessary to locate an absorbent towel or some other device to wipe and remove the water condensation from the reflecting surface before the act of shaving can be resumed and completed. If the room in which the act of shaving occurs is very small and inadequately ventilated, the reflecting surface may have to be repeatedly wiped in order to remove water condensation that may reform thereon after being initially removed. The necessity of locating suitable devices to wipe and remove water condensation from a reflecting surface often can be burdensome, irritating and time consuming, transforming the act of shaving from what should be a pleasant and satisfying experience into an annoying and tiring experience.

SUMMARY OF THE INVENTION

An object of the present invention is to provide a new and improved razor for use in performing the act of shaving.

Another object of the present invention is to provide a new and improved razor for performing the act of shaving that includes as a portion thereof a device for removing water and water condensation from a reflecting surface, such as a mirror.

Another object of the present invention is to provide a new and improved razor for performing the act of shaving that includes as a portion thereof a device for removing both shaving cream or lather from a portion of the anatomy to be shaved and water condensation from a reflecting surface, such as a mirror.

Another object of the present invention is to provide a new and improved replaceable cartridge that serves to house one or more sharpened razor blades and is designed to be removably attached to the body of a cartridge-type razor wherein the replaceable cartridge includes as a portion thereof a device for removing both shaving cream or lather from a portion of the anatomy to be shaved and water condensation from a reflecting surface, such as a mirror.

Briefly, the device of the present invention comprises a new and improved razor that includes as a component thereof means for wiping and removing water condensation from a reflecting surface, such as a mirror. The wiping and removing means comprises a squeegee formed from a soft or compliant elastomeric material, such as rubber or a suitable synthetic material. The squeegee also serves the additional function of being capable of removing shaving cream or lather from that portion of the anatomy to be shaved. The squeegee may be securely affixed as an integral portion of the head or of the body or handle of a razor. Alternatively, the squeegee may be affixed to a replaceable cartridge that houses one or more sharpened razor blades and is capable of being removably attached to the handle or body of a cartridge-type razor; or the squeegee may be formed as a separate component for attachment to the body or handle or a razor.

BRIEF DESCRIPTION OF THE DRAWING

The above and other objects and advantages and novel features of the present invention will become apparent from the following detailed description of an embodiment of the invention illustrated in the accompanying drawing wherein.

DESCRIPTION OF THE PREFERRED EMBODIMENT

Figure 1:
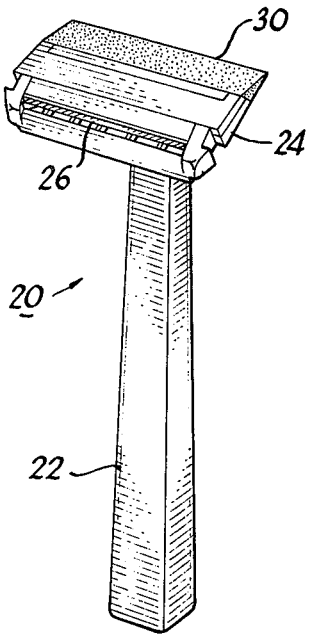
FIG. 1 is a front perspective view of a preferred embodiment of the invention that includes a squeegee integrally attached to the head of a razor.
Figure 2:
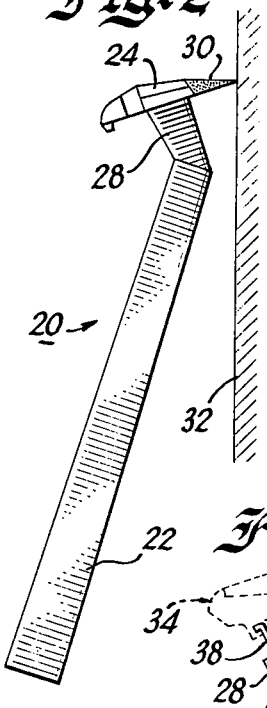
FIGS. 2 and 3 are, respectively, side and top perspective views of the device of FIG. 1 illustrating a function of the squeegee depicted therein.
Figure 3:
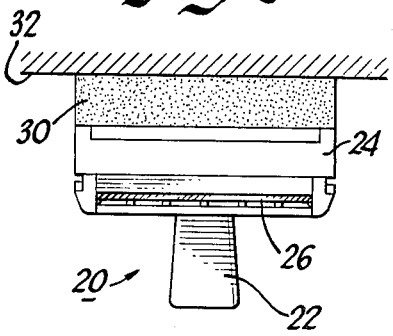

Referring to the drawing and initially to FIGS. 1–3, there is illustrated a new and improved razor 20 constructed in accordance with the principles of the present invention for performing the act of shaving during an individual's personal grooming routine. The razor 20 includes a body or handle 22 and a shaving head 24. The shaving head 24 houses one or more sharpened razor blades 26. As depicted in FIG. 2, the body or handle 22 includes a neck portion 28 that attaches the shaving head 24 at a comfortable shaving angle to the handle 22.

In accordance with an important feature of the present invention, the razor 20 includes means securely affixed to a portion of the razor 20 for wiping and removing water condensation due to steam or water vapor from a reflecting surface, such as a mirror. The water condensation wiping and removing means is hereinafter referred to as a squeegee. In FIGS. 1–3, a squeegee 30 is permanently or nonremovably, securely affixed to a portion of the shaving head 24 and is generally oppositely disposed from the exposed portions of the razor blades 26. The squegee 30 in the preferred embodiment extends along and is equal in width to the width of the shaving head 24 and has a thickness that tapers from a region of relatively greater thickness at the location of affixation to the shaving head 24 to a region of relatively less thickness at a location opposite from the location of affixation of the squeegee 30 to the shaving head 24. The squeegee 30 is preferrably formed from a soft or compliant elastomeric material, such as rubber or a suitable synthetic material, and may be securely affixed to the shaving head 24 by glue or by other suitable fastening means. The material used to form the squeegee 30 should be sufficiently soft or compliant so that the squeegee 30 adheres to the reflecting surface 32 to wipe and remove the water condensation from the reflecting surface 32. Forming the squeegee 30 from a rigid material would be less desirable since the squeegee 30 would then have a tendency to skip over the reflecting surface 32, thereby ineffectively or less effectively wiping or removing water condensation from the reflecting surface 32. Alternatively, if a sufficiently soft or compliant plastic is used to form the shaving head 24, the squeegee 30 may be formed of the same material as the shaving head 24 during the molding process used to form the shaving head 24.

As depicted in FIGS. 2 and 3, during the act of shaving, if there is a necessity to remove water condensation from a reflecting surface 32, such as a mirror, an individual may simply place the squeegee 30 against the reflecting surface and wipe the water condensation therefrom. The squeegee 30 also serves an additional important function of being capable, when not being employed to remove water condensation from a reflecting surface, of removing shaving cream or lather from those portions of the anatomy to be shaved.

Preferably, the squeegee 30 should be formed to extend in a direction generally opposite to the direction along which the exposed sharpened edges of the razor blades 26 extend so that, under normal shaving conditions, the squeegee 30 will not contact portions of the anatomy in such a manner as to interfer with or interrupt the act of shaving. In a preferred embodiment of the present invention, the squeegee 30 should extend generally along a plane parallel to the plane of the exposed portions of the razor blades 26.

Figure 11:
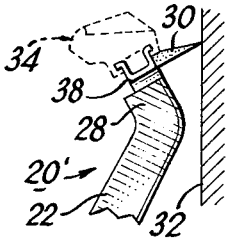
FIG. 11 is a fragmentary, side perspective view of an alternative embodiment of the invention in which a cartridge-type razor includes a squeegee integrally attached to the body of the razor.
Figure 4:
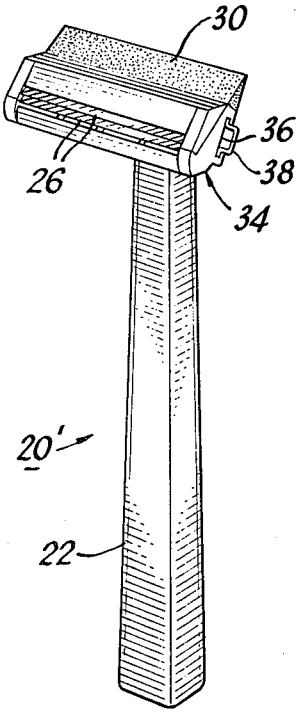
FIG. 4 is a front perspective view of an alternative embodiment of the invention in which a cartridge type razor includes a replaceable cartridge with a squeegee integrally attached thereto.
Figure 5:
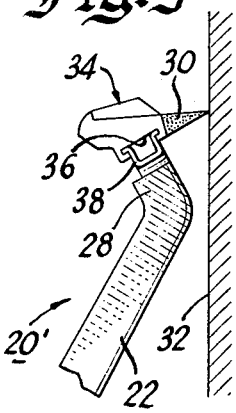
FIG. 5 is a fragmentary, side perspective view of the device of FIG. 4 illustrating a function of the squeegee depicted therein.
Figure 6:
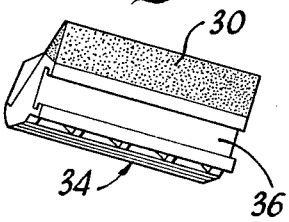
FIG. 6 is a bottom perspective view of a replaceable cartridge suitable for use in the device depicted in FIGS. 4 and 5 having a squeegee integrally formed thereon.

FIGS. 4 through 6 depict an alternative embodiment of the present invention wherein a cartridge-type razor 20' includes a replaceable cartridge 34 removably secured to the handle 22. The cartridge 34 houses one or more sharpened razor blades 26 and further includes a squeegee 30 securely affixed to the cartridge 34 at an end remote from the razor blades 26. The squeegee 30 of FIGS. 4 through 6 preferrably is formed of the same material and is attached to the cartridge 34 in the same manner as described hereinabove with respect to the embodiment of FIGS. 1–3. However, for purposes of illustration, the cross-sectional configuration or tapered configuration of the squeegee 30 is slightly different in the embodiment of FIGS. 4–6 as compared to the embodiment of FIGS. 1–3. The cartridge 34 includes a grooved portion 36 that enables the cartridge 34 to be securely received and engaged by a generally U-shaped metal or plastic channel 38 affixed to the neck portion 28 of the razor 20' to enable the cartridge 34 to be removably secured to the handle 22. As an alternative method of attachment to a cartridge-type razor 20' (FIG. 11), the squeegee 30 may be securely affixed to the body 22 of the razor 20', for example, to the channel 38, thereby to enable the razor 20' to utilize commercially available replaceable cartridges 34 that are not formed with the squeegee 30 thereon (as depicted in dotted line form in FIG. 11).

Figure 7:
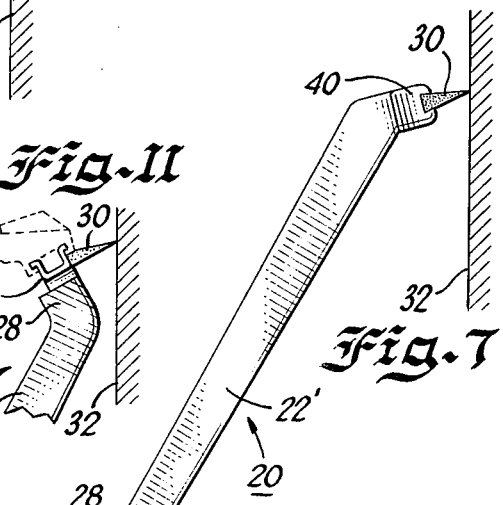
FIG. 7 is a side perspective view of an alternative embodiment of the present invention that includes a squeegee integrally formed on the body or handle of a razor.
Figure 8:
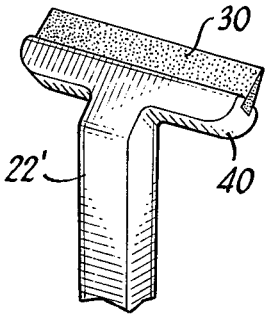
FIG. 8 is a fragmentary, bottom perspective view of a portion of the device of FIG. 7 illustrating the form of the squeegee depicted therein.

In accordance with a further alternative embodiment of the present invention (FIGS. 7–8), the squeegee 30 may be formed as an integral portion of the razor 20 and located at the lowermost end of the handle 22 distant from the location of the shaving head 24. The squeegee 30 of FIGS. 7 and 8 preferably is formed from the same material and in the same manner as the squeegee 30 in the embodiment of FIGS. 1–3 and in the embodiment of FIGS. 4–6. In the embodiment of FIGS. 7 and 8, the squeegee 30 is attached to an elongated transverse portion 40 of a generally T-shaped body or handle 22'. Normally, for purposes of rigidity, the handle 22' is formed from a rigid plastic as compared to the soft or compliant rubber or synthetic material used to form the squeegee 30.

Figure 9:
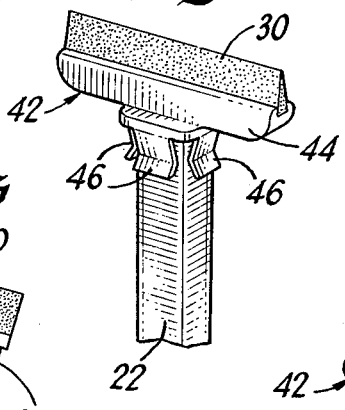
FIG. 9 is a fragmentary, front perspective view of an alternative embodiment of the present invention that includes a squeegee removably affixed to the lowermost end of the body or handle of a razpor.
Figure 10:
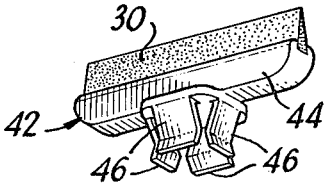
FIG. 10 is a front perspective view of the squeegee depicted in FIG. 9.

In accordance with a further alternative embodiment of the present invention (FIGS. 9–10), the squeegee 30 may be securely affixed to a separate attachment 42 for a razor 20 or 20'. The separate attachment 42 includes the squeegee 30 secured to an elongated base 44 formed, preferably, from a more rigid material, such as a rigid plastic or metal, than the material used to form the squeegee 30. Secured to or integrally formed with the elongated base 44 is means for securing the separate attachment 42 to the lowermost end of the handle 22 of a razor 20 or 20'. In the preferred embodiment of FIGS. 9–10, the means for securing the separate attachment 42 to the handle 22 comprises four resilient, spring clips or spring fingers 46 formed from plastic or metal material. Upon receipt of the lowermost end of the handle 22, the resilient spring fingers 46 are deflected radially outwardly to resiliently engage outer peripheral portions of the handle 22, thereby securely affixing the separate attachment 42, including the squeegee 30, to the handle 22.

Obviously, many modifications and variations of the present invention are possible in light of the above teachings. Thus, it is to be understood that, within the scope of the appended claims, the invention may be practiced otherwise than as specifically described hereinabove.

What is claimed and desired to be secured by Letters Patent of the United States is:

1. A personal grooming instrument comprising at least one razor blade having an exposed sharpened edge, an elongated handle for engagement by a hand of an operator of the instrument, means for securing said razor blade to said handle, means for removing shaving cream or lather from those portions of the anatomy to be shaved, said removing means comprising an elongated liquid impervious squeegee formed from a compliant material, and means for securing said squeegee to said instrument at a location remotely disposed from any and all exposed sharpened edges of any and all razor blades secured to said handle to preclude the simultaneous contacting of those portions of the anatomy to be shaved by said squeegee and by any of said exposed sharpened edges.

2. A personal grooming instrument as recited in claim 1 wherein said razor blade securing means comprises a shaving head within which said razor blade is rigidly mounted.

3. A personal grooming instrument as recited in claim 2 wherein said shaving head forms an integral portion of said instrument.

4. A personal grooming instrument as recited in claim 2 wherein said squeegee is affixed to said shaving head and forms a nonremovable portion of said shaving head.

5. A personal grooming instrument as recited in claim 1 wherein said compliant material is an elastomeric material.

6. A personal grooming instrument as recited in claim 5 wherein said elastomeric material is rubber.

7. A personal grooming instrument as recited in claim 1 wherein said compliant material is plastic.

8. A personal grooming instrument as recited in claim 1 wherein said razor blade securing means comprises a replaceable cartridge removably secured to said handle.

9. A personal grooming instrument as recited in claim 8 wherein said squeegee comprises a nonremovable portion of said replaceable cartridge.

10. A personal grooming instrument as recited in claim 9 wherein said squeegee extends along the width of said replaceable cartridge in a direction generally opposite to the direction of said exposed sharpened edge of said razor blade.

11. A personal grooming instrument as recited in claim 10 wherein the width of said squeegee is at least equal to the width of said replaceable cartridge.

12. A personal grooming instrument as recited in claim 1 wherein said squeegee has a thickness that tapers from a region of relatively greater thickness at the location of affixation to said instrument to a region of relatively less thickness at a location opposite from said location of affixation of said squeegee to said instrument.

13. A personal grooming instrument as recited in claim 1 wherein said squeegee is disposed generally transverse to the longitudinal axis of the said elongated handle.

14. A personal grooming instrument as recited in claim 13 wherein said squeegee is disposed on said elongated handle at a location opposite to and remote from the location of said razor blade securing means.

15. A personal grooming instrument as recited in claim 14 wherein said squeegee forms an integral portion of said elongated handle.

16. A personal grooming instrument as recited in claim 14 further comprising means for releasably securely affixing said squeegee to said elongated handle.

17. A personal grooming instrument as recited in claim 16 wherein said squeegee releasably securely affixing means comprises a plurality of resilient spring fingers resiliently engaging peripheral portions of a longitudinal end of said elongated handle at a location opposite to and remote from the location of said razor blade securing means.

18. A replaceable cartridge for attachment to a cartridge type razor comprising at least one razor blade having an exposed sharpened edge, means permanently mounting said razor blade in said replaceable cartridge, means for removably securely affixing said cartridge to said cartridge type razor and an elongated liquid impervious squeegee formed of a compliant material affixed to said replaceable cartridge at a location remotely disposed from said exposed sharpened edge to preclude the simultaneous contacting of those portions of the anatomy to be shaved by said squeegee and by said exposed sharpended edge, said squeegee being capable of removing shaving cream or lather from those portions of the anatomy to be shaved.

19. A replaceable cartridge for attachment to a cartridge type razor as recited in claim 18 wherein said squeegee is nonremovably affixed to said replaceable cartridge.

20. A replaceable cartridge for attachment to a cartridge type razor as recited in claim 18 wherein said compliant material is an elastomeric material.

21. A replaceable cartridge for attachment to a cartridge type razor as recited in claim 18 wherein said squeegee extends along the width of said replaceable cartridge and has a tapered cross-sectional configuration in a direction transverse to the width of said replaceable cartridge and includes a region of relatively greater thickness at the location of affixation to said replaceable cartridge and a region of relatively less thickness at a location remote from the point of affixation of said squeegee to said replaceable cartridge.

* * * * *